US006818036B1

(12) United States Patent
Seaman

(10) Patent No.: US 6,818,036 B1
(45) Date of Patent: Nov. 16, 2004

(54) CYCLONIC VACUUM CLEANER

(75) Inventor: Robert Brian Seaman, Bath (GB)

(73) Assignee: Dyson Limited, Wiltshire (GB)

( * ) Notice: Subject to any disclaimer, the term of this patent is extended or adjusted under 35 U.S.C. 154(b) by 387 days.

(21) Appl. No.: 10/111,191

(22) PCT Filed: Oct. 13, 2000

(86) PCT No.: PCT/GB00/03921

§ 371 (c)(1),
(2), (4) Date: Jun. 13, 2002

(87) PCT Pub. No.: WO01/28400

PCT Pub. Date: Apr. 26, 2001

(30) Foreign Application Priority Data

Oct. 20, 1999 (GB) ..... 9924771

(51) Int. Cl.[7] ..... B01D 45/12

(52) U.S. Cl. ..... 55/426; 55/429; 55/459.1; 55/DIG. 3; 15/327.7; 15/319; 15/340.1; 15/353

(58) Field of Search ..... 55/345, 424, 426, 55/429, 459.1, DIG. 33; 15/327.1, 327.2, 327.7, 319, 353, 340.1

(56) References Cited

U.S. PATENT DOCUMENTS 5,090,976 A 2/1992 Dyson
6,146,434 A 11/2000 Scalfani et al.
6,502,277 B1 * 1/2003 Petersson et al. ..... 15/352
6,553,612 B1 * 4/2003 Dyson et al. ..... 15/340.1
2003/0028994 A1 * 2/2003 Kitamura et al. ..... 15/353

FOREIGN PATENT DOCUMENTS

WO WO 96/22726 8/1996
WO WO 97/08983 3/1997

* cited by examiner

*Primary Examiner*—Robert A. Hopkins
(74) *Attorney, Agent, or Firm*—Morrison & Foerster LLP

(57) ABSTRACT

A vacuum cleaner comprises a cylconic separation unit with a dirty air inlet and a cleaned air outlet at a first end and a dirt collection portion at a second end. The separation unit is supported on the cleaner such that the inlet is located in a lower portion of the first end and such that, in normal use, the longitudinal axis of the chamber lies in, or can be brought to lie in, a substantially horizontal position. A shield member is provided at the inlet for shielding the inlet from the dirt collection portion of the chamber. This helps to prevent dirt from becoming re-entrained in the airflow and the inlet and dirt from falling from the inlet when a user removes the separation unit. The shield also helps to straighten incoming airflow through the inlet. The shield can be formed integrally with a shroud or other insert that fits inside the separation unit.

23 Claims, 10 Drawing Sheets

CYCLONIC VACUUM CLEANER

FIELD OF THE INVENTION

The present invention relates to a cyclonic vacuum cleaner.

BACKGROUND OF THE INVENTION

Cyclonic vacuum cleaners typically have a dirty air inlet, a clean air outlet, an airflow path between the inlet and outlet, and dirt and dust separating apparatus arranged in the airflow path between the dirty air inlet and the clean air outlet. The dirt and dust separating apparatus comprises a centrifugal separator having a cylindrical or tapering chamber with a tangential inlet at a first end and a dirt and dust collecting portion at a second end opposite the first end. In use, dirty air is drawn into the cleaner by means of a fan and motor unit through the dirty air inlet. The dirty air is passed to the centrifugal separator where it enters the cylindrical or tapering chamber via the tangential inlet. The dirt and dust is separated from the airflow within the chamber and collected in the dirt and dust collecting portion thereof whilst the clean air exits the cleaner via the clean air outlet.

The term "cyclonic vacuum cleaner" is applicable to any type of vacuum cleaner, including upright, cylinder or canister, backpack, industrial and robotic cleaners. Many types of cyclonic vacuum cleaner are know. Examples of cyclonic upright cleaners are shown and described in, inter alia, EP 0 042 723, EP 0 037 674, EP 0 636 338, U.S. Pat. No. 4,593,429 and US Re 32 257. A cyclonic backpack cleaner is disclosed in U.S. Pat. No. 5,267,371 and a cylinder cyclonic cleaner is disclosed in EP 0 778 745.

Generally in known cyclonic vacuum cleaners, the cyclone arrangement is such that, in normal modes of operation, the cyclone is orientated so that the longitudinal axis thereof is either vertical or inclined at an acute angle to the vertical. This is to allow the effects of gravity to assist the collection of the dirt and dust separated from the airflow. The collected dirt and dust drops to the end of the bin remote from the inlet and is collected there. In some arrangements, the cyclonic separator includes two (or more) cyclones. However, in all cases, both or all of the cyclones are arranged so that the axes of the cyclones are, in the normal mode of operation, vertical or inclined at an acute angle to the vertical so that the effects of gravity can be put to good use in assisting the separation and collection of the separated dirt and dust.

There are instances when the vertical height of a vacuum cleaner is preferably kept to a minimum, for example when the vacuum cleaner is required to be used underneath articles of furniture or in other area, where there is a height restriction. Vacuum cleaners of the type already known can be used for short periods in a mode which brings the cyclonic separator into or near to a horizontal position (i.e. with the axis of the cyclone lying horizontally), but the effects of gravity are then lost and the orientation of the cyclone and its collecting chamber or bin can result in reduced separation efficiency of the cyclone. It is therefore generally understood that a cyclone which is orientated with its axis lying horizontally is not as efficient at separating dirt and dust from an airflow as one which has its axis arranged vertically, or at most inclined at an acute angle to the vertical. Our copending International patent application WO 00/36968 describes a cyclonic vacuum cleaner where the cyclonic separator is mounted with its longitudinal axis lying in a substantially horizontal position. This minimises the vertical height of the cleaner. We have found that, under certain conditions, it is possible for dust to be re-entrained into the airstream during use or for dust to fall out of the inlet when emptying such a cleaner.

SUMMARY OF THE INVENTION

The present invention seeks to provide an improved cyclonic vacuum cleaner of the kind which can operate in a substantially horizontal position.

An aspect of the invention provides a vacuum cleaner comprising a cyclonic separation unit, the unit comprising a chamber having a dirty air inlet and a cleaned air outlet at a first end thereof and a dirt collection portion at a second end thereof, which unit, in use, cleans dirty air entering the inlet by centrifugal separation and stores the dirt in the dirt collection portion, the cyclonic separation unit being supported on the cleaner such that the inlet is located in a lower portion of the first end of the chamber and such that, in normal use, the longitudinal axis of the chamber lies in, or can be brought to lie in, a substantially horizontal position, and wherein a shield member is provided at the inlet for shielding the inlet from the dirt collection portion of the chamber.

This helps to provide a cyclonic vacuum cleaner which is compact in the vertical direction, and therefore which is capable of cleaning within confined areas having height restrictions, while the shield member minimises the problems of re-entrainment of dust during horizontal operation or loss of dust while removing the separation unit from the cleaner.

One application of the cleaner is in the field of robotic vacuum cleaners, i.e. cleaners which carry navigation equipment and sensors which will allow the vacuum cleaner to navigate itself around a room or other area to be cleaned without human intervention. In such an application, the vacuum cleaner includes supporting wheels, drive means for driving the wheels, sensors for sensing objects in the path of the cleaner and control means for avoiding contact with any such objects. However, the invention is applicable to vacuum cleaners which are not robotic in nature.

Preferably the circumferential length of the shield member is at least as great as the circumferential length of the inlet so that the shield fully covers the inlet.

The shield can take the form of a fin which extends radially inwards from an outer wall of the chamber. Advantageously, the separation unit has a helical entry guide extending from one side of the inlet and the shield extends parallel to the entry guide on the other side of the inlet. The shield member can be an extension of the helical entry guide, forming the beginning of a second revolution around the chamber.

Preferably, the shield extends inwardly from an outer wall of the chamber to meet an insert which fits inside the chamber adjacent the inlet. Indeed, the shield can be formed integrally with the insert. The insert can be a shroud.

Preferably, the inlet is oriented in a substantially vertical direction and the shield extends vertically alongside the inlet.

Preferably, the separation unit is mounted above the cleaning head of the cleaner and is directly coupled to an output of the cleaner head. The shield has been found to offer a flow-straightening effect which permits the inlet to the separation unit to be positioned more closely to the cleaning head.

Preferably the inlet to the separation unit is a tangential inlet through the side of the chamber.

BRIEF DESCRIPTION OF THE DRAWINGS

Further features and advantages of the invention will become apparent from the following description of an embodiment of the invention, which is given by way of example only and is not intended to be limiting, with reference to the accompanying drawings, in which.

DETAILED DESCRIPTION OF THE INVENTION

Figure 1:
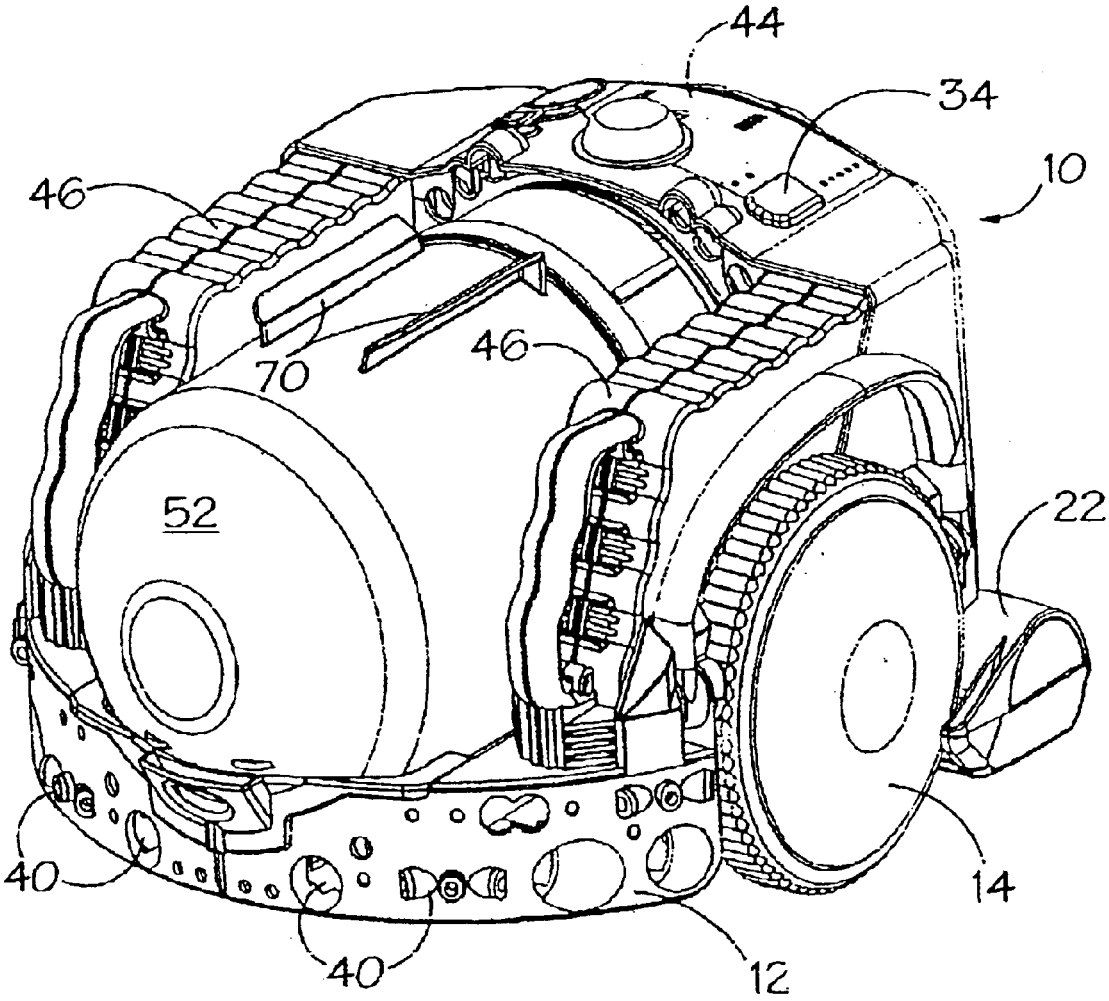
FIG. 1 is a perspective view of a vacuum cleaner according to the invention.

The vacuum cleaner 10 shown in the drawings has a supporting chassis 12 which is generally circular in shape and is supported on two driven wheels 14 and a castor wheel 16. The chassis 12 is preferably manufactured from high-strength moulded plastics material, such as ABS, but can equally be made from metal such as aluminium or steel. The chassis 12 provides support for the components of the cleaner 10 which will be described below. The driven wheels 14 are arranged at either end of a diameter of the chassis 12, the diameter lying perpendicular to the longitudinal axis 18 of the cleaner 10. Each driven wheel 14 is moulded from a high-strength plastics material and carries a comparatively soft, ridged band around its circumference to enhance the grip of the wheel 14 when the cleaner 10 is traversing a smooth floor. The soft, ridged band also enhances the ability of the wheels to mount or climb over small obstacles. The driven wheels 14 are mounted independently of ore another via support bearings (not shown) and each driven wheel 14 is connected directly to a motor 15 which is capable of driving the respective wheel 14 in either a forward direction or a reverse direction. By driving both wheels 14 forward at the same speed, the cleaner 10 can be driven in a forward direction. By driving both wheels 14 in a reverse direction at the same speed, the cleaner 10 can be driven in a backward direction. By driving the wheels 14 in opposite directions, the cleaner 10 can be made to rotate about its own central axis so as to effect a turning manoeuvre. The aforementioned method of driving a vehicle is well known and will not therefore be described any further here.

Figure 4:
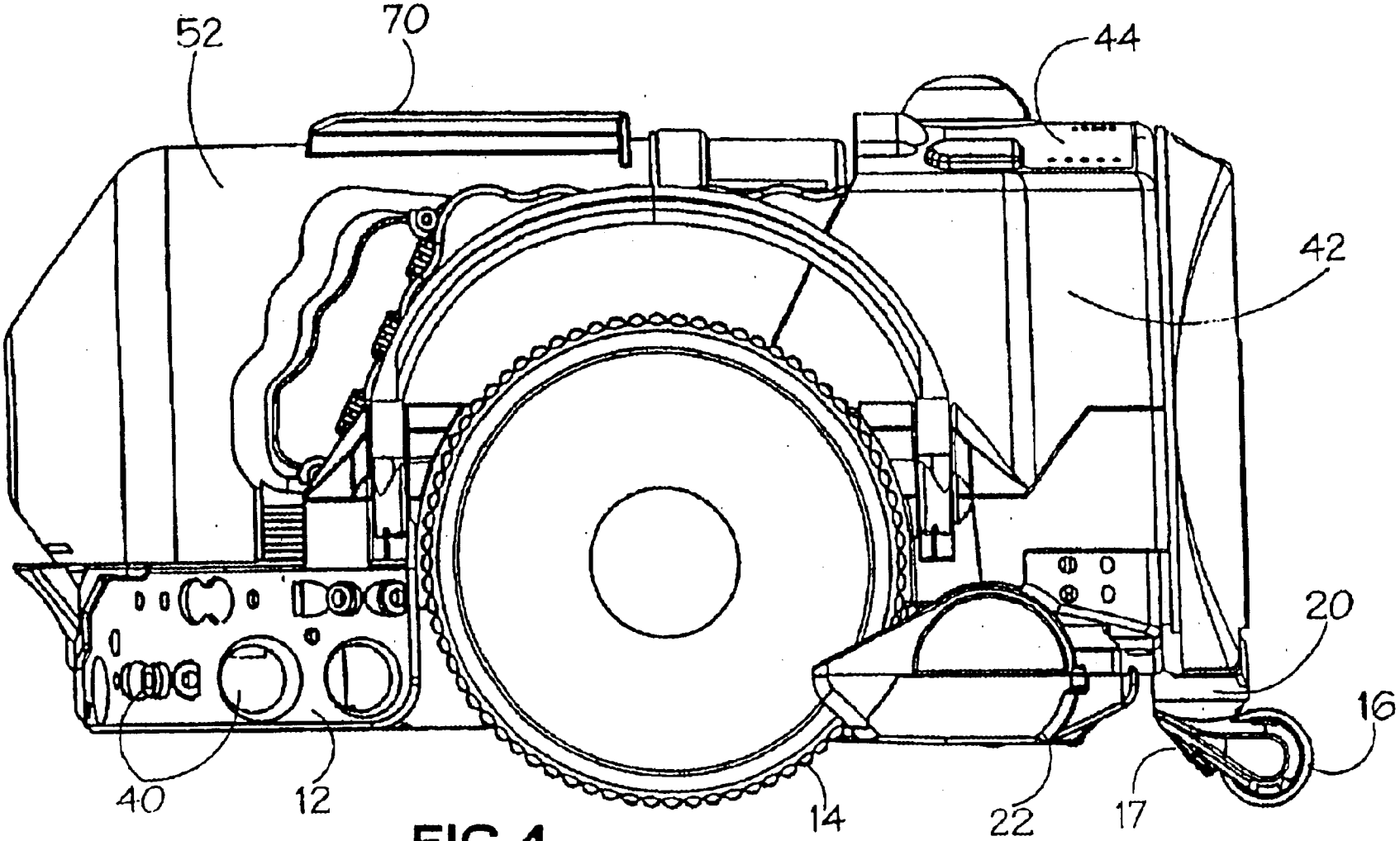
FIG. 4 is a side view of the vacuum cleaner of FIG. 1.

The castor wheel 16 is significantly smaller in diameter than the driven wheels 14 as can be seen from, for example, FIG. 4. The castor wheel 16 is not driven and merely serves to support the chassis 12 at the rear of the cleaner 10. The location of the castor wheel 16 at the trailing edge of the chassis 12, and the fact that the castor wheel 16 is swivellingly mounted on the chassis by means of a swivel joint 20, allows the castor wheel 16 to trail behind the cleaner 10 in a manner which does not hinder the manoeuvrability of the cleaner 10 whilst it is being driven by way of the driven wheels 14. The swivel joint 20 is most clearly shown in FIG. 6. The castor wheel 16 is fixedly attached to an upwardly extending cylindrical member 20*a* which is received by an annular housing 20*b* to allow free rotational movement of the cylindrical member 20*a* therewithin. This type of arrangement is well known. The castor wheel 16 can be made from a moulded plastics material or can be formed from another synthetic material such as Nylon.

Mounted on the underside of the chassis 12 is a cleaner head 22 which includes a suction opening 24 facing the surface on which the cleaner 10 is supported. The suction opening 24 is essentially rectangular and extends across the majority of the width of the cleaner head 22. A brush bar 26 is rotatably mounted in the suction opening 24 and a motor 28 is mounted on the cleaner head 22 for driving the brush bar 26 by way of a drive belt (not shown) extending between a shaft of the motor 28 and the brush bar 26. The cleaner head 22 is mounted on the chassis 12 in such a way that the cleaner head 22 is able to float on the surface to be cleaned. This is achieved in this embodiment in that the cleaner head 22 is pivotally connected to an arm (not shown) which in turn is pivotally connected to the underside of the chassis 12. The double articulation of the connection between the cleaner head 22 and the chassis 12 allows the cleaner head to move freely in a vertical direction with respect to the chassis 12. This enables the cleaner head to climb over small obstacles such as books, magazines, rug edges, etc. Obstacles of up to approximately 25 mm in height can be traversed in this way. A flexible connection 30 (see FIG. 7) is located between a rear portion of the cleaner head 22 and an inlet port 32 (see also FIG. 7) located in the chassis 12. The flexible connection 30 consists of a rolling seal, one end of which is sealingly attached to the upstream mouth of the inlet port 32 and the other end of which is sealingly attached to the cleaner head 22. When the cleaner head 22 moves upwardly with respect to the chassis 12, the rolling seal 30 distorts or crumples to accommodate the upward movement of the cleaner head 22. When the cleaner head 22 moves downwardly with respect to the chassis 12, the rolling seal 30 unfolds or extends into an extended position to accommodate the downward movement.

In order to assist the cleaner head 22 to move vertically upwards when an obstacle is encountered, forwardly projecting ramps 36 are provided at the front edge of the cleaner head 22. In the event that an obstacle is encountered, the obstacle will initially abut against the ramps 36 and the inclination of the ramps will then lift the cleaner head 22 over the obstacle in question so as to avoid the cleaner 10 from becoming lodged against the obstacle. The cleaner head 22 is shown in a lowered position in FIG. 6 and in a raised position in FIG. 4. The castor wheel 16 also includes a ramped portion 17 which provides additional assistance when the cleaner 10 encounters an obstacle and is required to climb over it. In this way, the castor wheel 16 will not become lodged against the obstacle after the cleaner head 22 has climbed over it.

Figure 2:
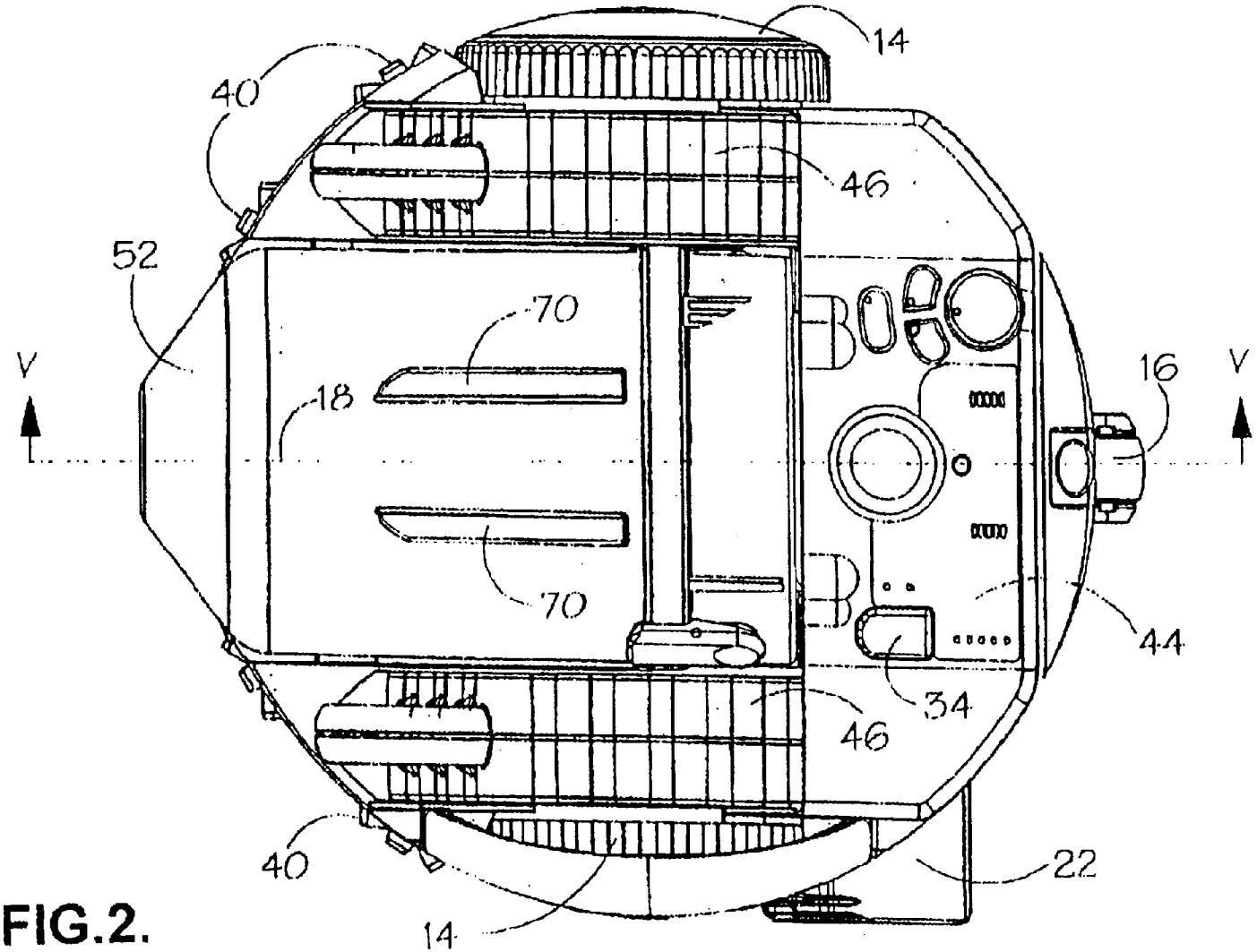
FIG. 2 is a plan view of the vacuum cleaner of FIG. 1.
Figure 3:
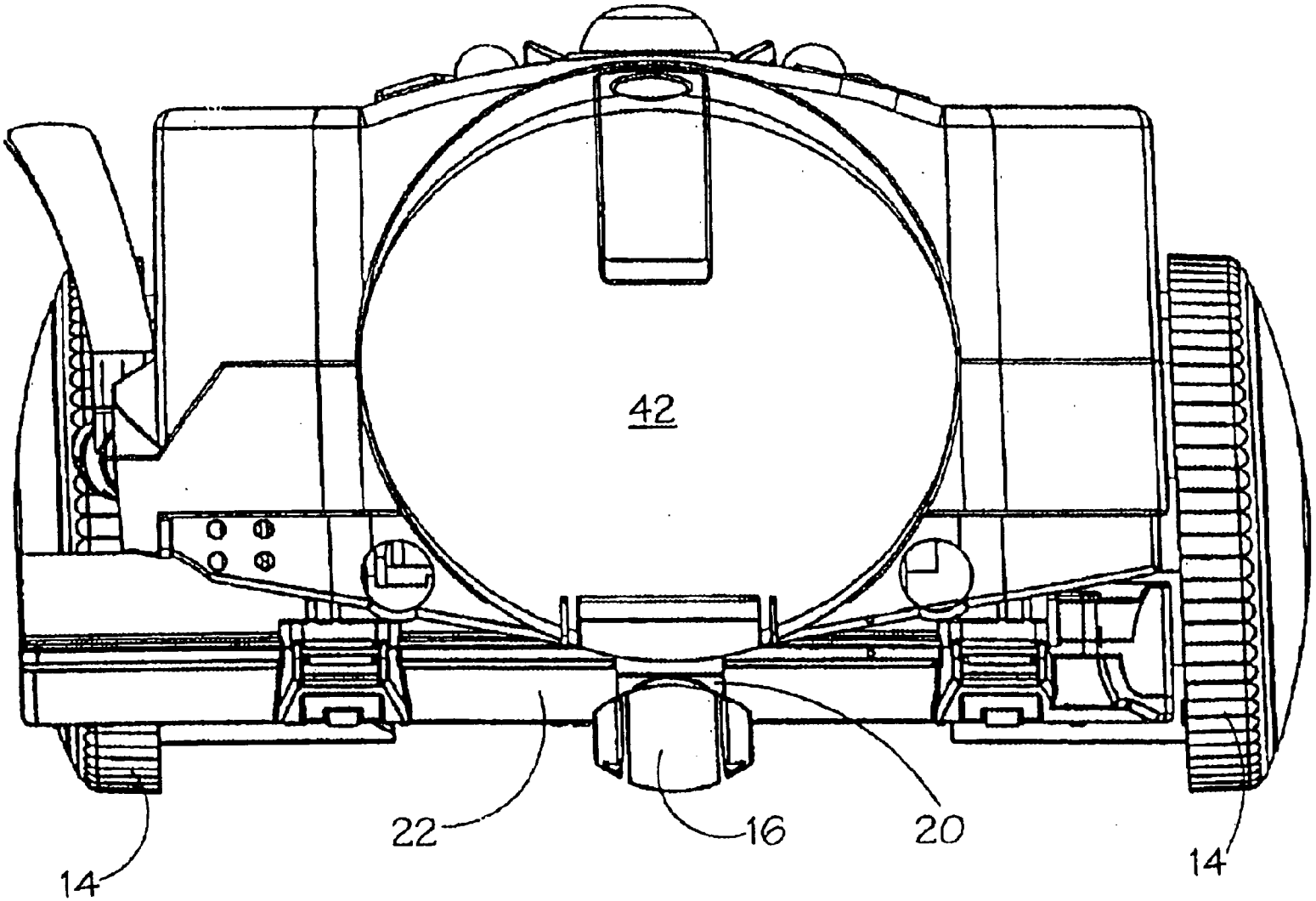
FIG. 3 is a rear view of the vacuum cleaner of FIG. 1.
Figure 5:
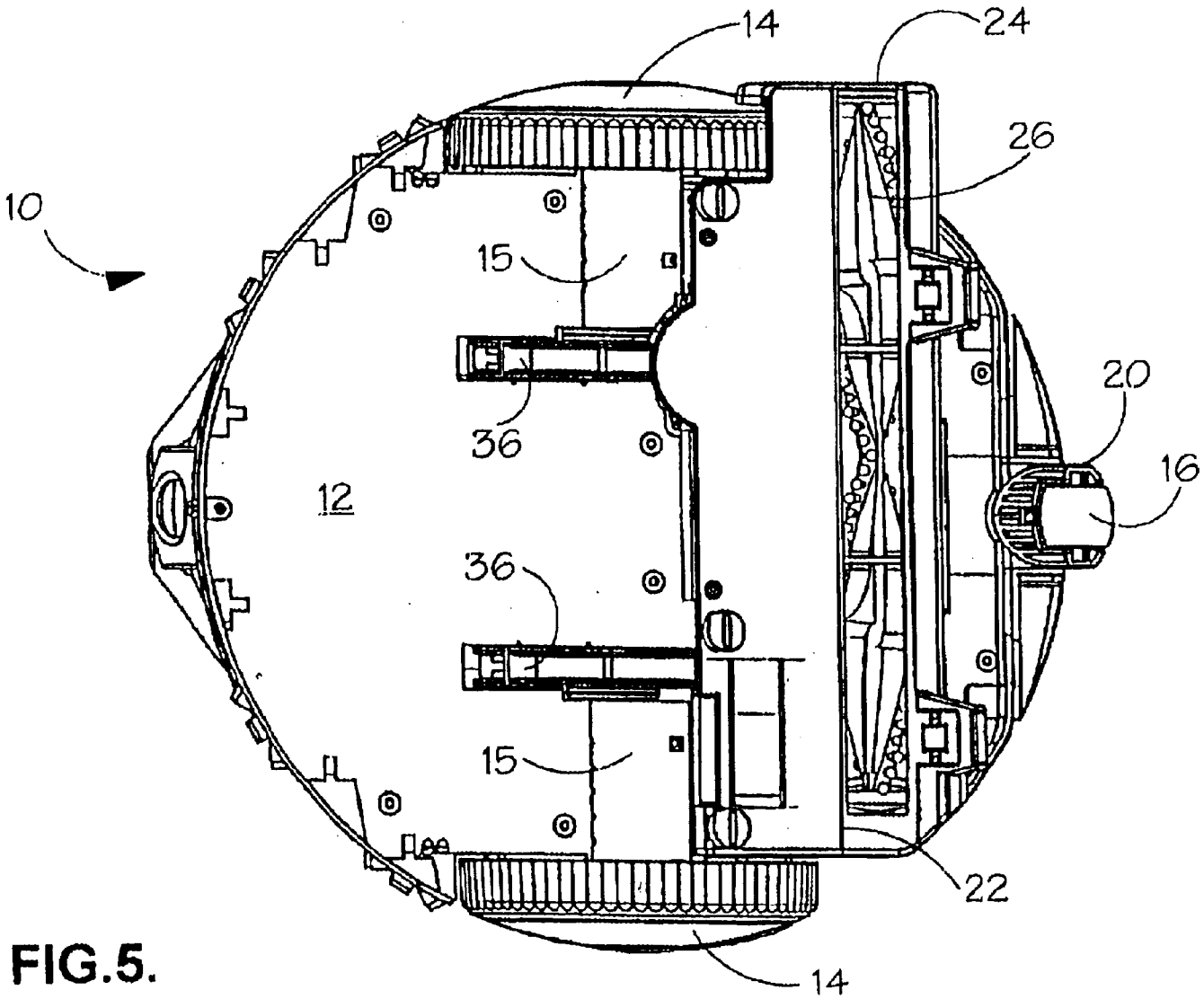
FIG. 5 is an underneath view of the vacuum cleaner of FIG. 1.

As can be seen from FIGS. 2 and 5, the cleaner head 22 is asymmetrically mounted on the chassis 12 so that one side of the cleaner head 22 protrudes beyond the general circumference of the chassis 12. This allows the cleaner 10 to clean up to the edge of a room on the side of the cleaner 10 on which the cleaner head 22 protrudes.

The chassis 12 carries a plurality of sensors 40 which are designed and arranged to detect obstacles in the path of the cleaner 10 and its proximity to, for example, a wall or other boundary such as a piece of furniture. The sensors 40 comprise several ultra-sonic sensors and several infra-red sensors. The array illustrated in FIGS. 1 and 4 is not intended to be limitative and the arrangement of the sensors does not form part of the present invention. Suffice it to say that the vacuum cleaner 10 carries sufficient sensors and detectors 40 to enable the cleaner 10 to guide itself or to be guided around a predefined area so that the said area can be cleaned. Control software, comprising navigation controls and steering devices, is housed within a housing 42 located beneath a control panel 44 or elsewhere within the cleaner. Battery packs 46 are mounted on the chassis 12 inwardly of the driven wheels 14 to provide power to the motors for driving the wheels 14 and to the control software. The battery packs 46 are removable to allow them to be transferred to a battery charger (not shown).

The vacuum cleaner 10 also includes a motor and fan unit 50 supported on the chassis 12 for drawing dirty air into the vacuum cleaner 10 via the suction opening 24 in the cleaner head 22. The chassis 12 also carries a cyclonic separator 52 for separating din and dust from the air drawn into the cleaner 10. The features of the cyclonic separator 52 are best seen from FIGS. 6 and 7. The cyclonic separator 52 comprises an outer cyclone 54 and an inner cyclone 56 arranged concentrically therewith, both cyclones 54,56 having their coaxial axes lying horizontally. The outer cyclone 54 comprises an entry portion 58 which communicates directly with the inlet port 32 as shown in FIG. 7. The inlet port 32 and the entry portion 58 together provide an entry into the outer cyclone 54 which is tangential. The direction of the tangential inlet is vertically upward, as shown in FIG. 7. It will also be seen from FIG. 7 that the inlet, particularly the lower edge 33 thereof, is located so that it is above the lowermost edge or side 35 of the outer cyclone 54. This helps to prevent re-entrainment of dirt and dust into the airflow during operation. The entry portion 58 which is cylindrical and has an end wall 60 which is generally helical. The entry portion 58 opens directly into a cylindrical bin 62 having an outer wall 64 whose diameter is the same as that of the entry portion 58. The cylindrical bin 62 is made from a transparent plastics material to allow a user to view the interior of the outer cyclone 54. The end of the bin 62 remote from the entry portion 58 is frusto-conical in shape and closed. A locating ring 66 is formed integrally with the end of the bin at a distance from the outer wall 64 thereof and a dust ring 68 is also formed integrally with the end of the bin 62 inwardly of the locating ring 66. Located on the outer surface of the bin 62 are two opposed gripper portions 70 which are adapted to assist a user to remove the separator 52 from the chassis 12 for emptying purposes. Specifically, the gripper portions 70 are moulded integrally with the transparent bin 62 and extend upwardly and outwardly from the outer wall 64 so as to form an undercut profile as shown in FIG. 1.

The inner cyclone 56 is formed by a partially-cylindrical, partially-frusto-conical cyclone body 72 which is rigidly attached to the end face of the entry portion 58. The cyclone body 72 lies along the longitudinal axis of the transparent bin 62 and extends almost to the end face thereof so that the distal end 72*a* of the cyclone body 72 is surrounded by the dust ring 68. The gap between the cone opening at the distal end 72*a* of the cyclone body 72 and the end face of the bin 62 is preferably less than 8 mm.

A fine dust collector 74 is located in the bin 62 and is supported by the locating ring 66 at one end thereof. The fine dust collector 74 is supported at the other end thereof by the cyclone body 72. Seals 76 are provided between the fine dust collector 74 and the respective support at either end. The fine dust collector 74 has a first cylindrical portion 74*a* adapted to be received within the locating ring 66, and a second cylindrical portion 74*b* having a smaller diameter than the first cylindrical portion 74*a*. The cylindrical portions 74*a*, 74*b* are joined by a frusto-conical portion 74*c* which is integrally moulded therewith.

Figure 6:
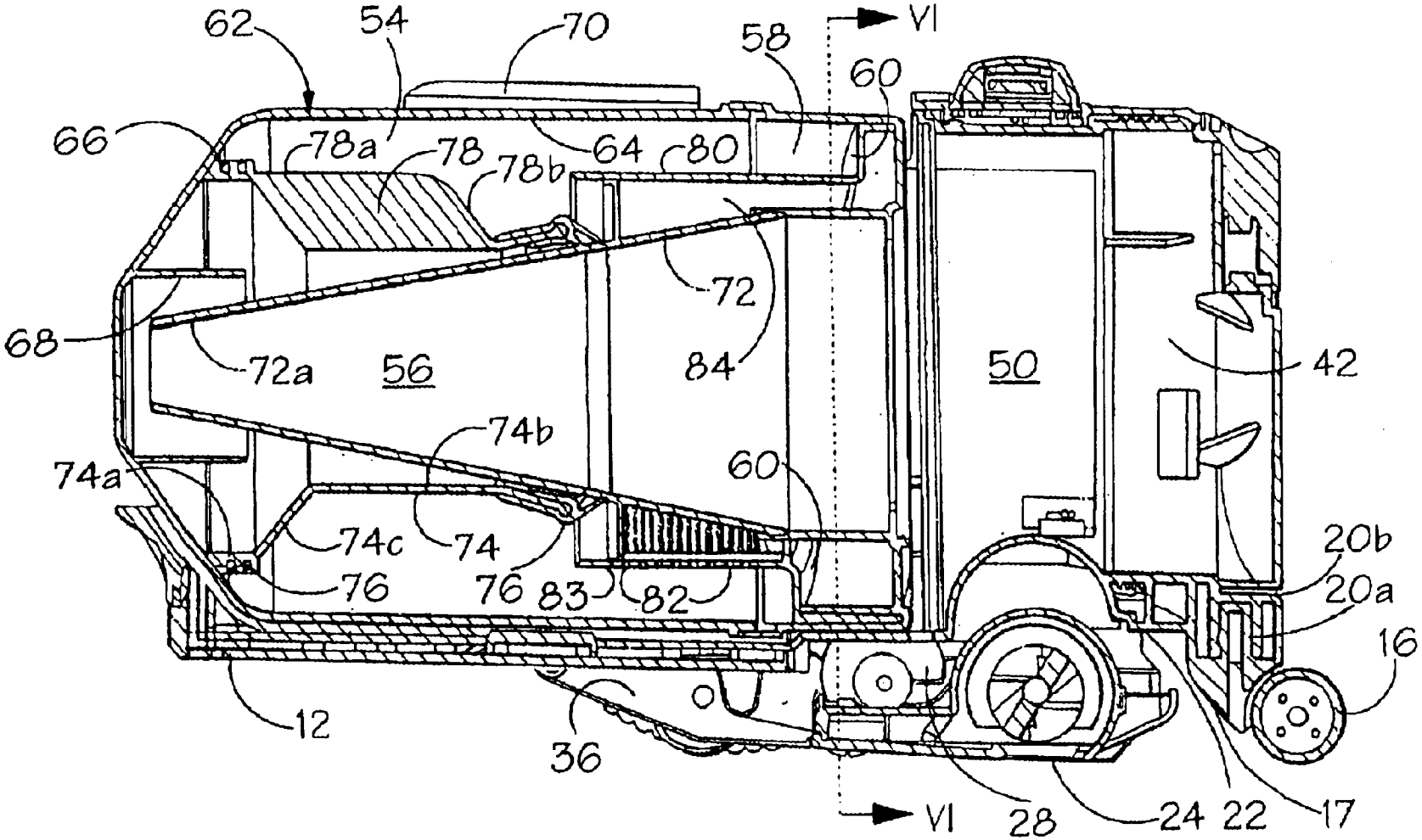
FIG. 6 is a sectional view taken along the line V—V of FIG. 2.
Figure 7:
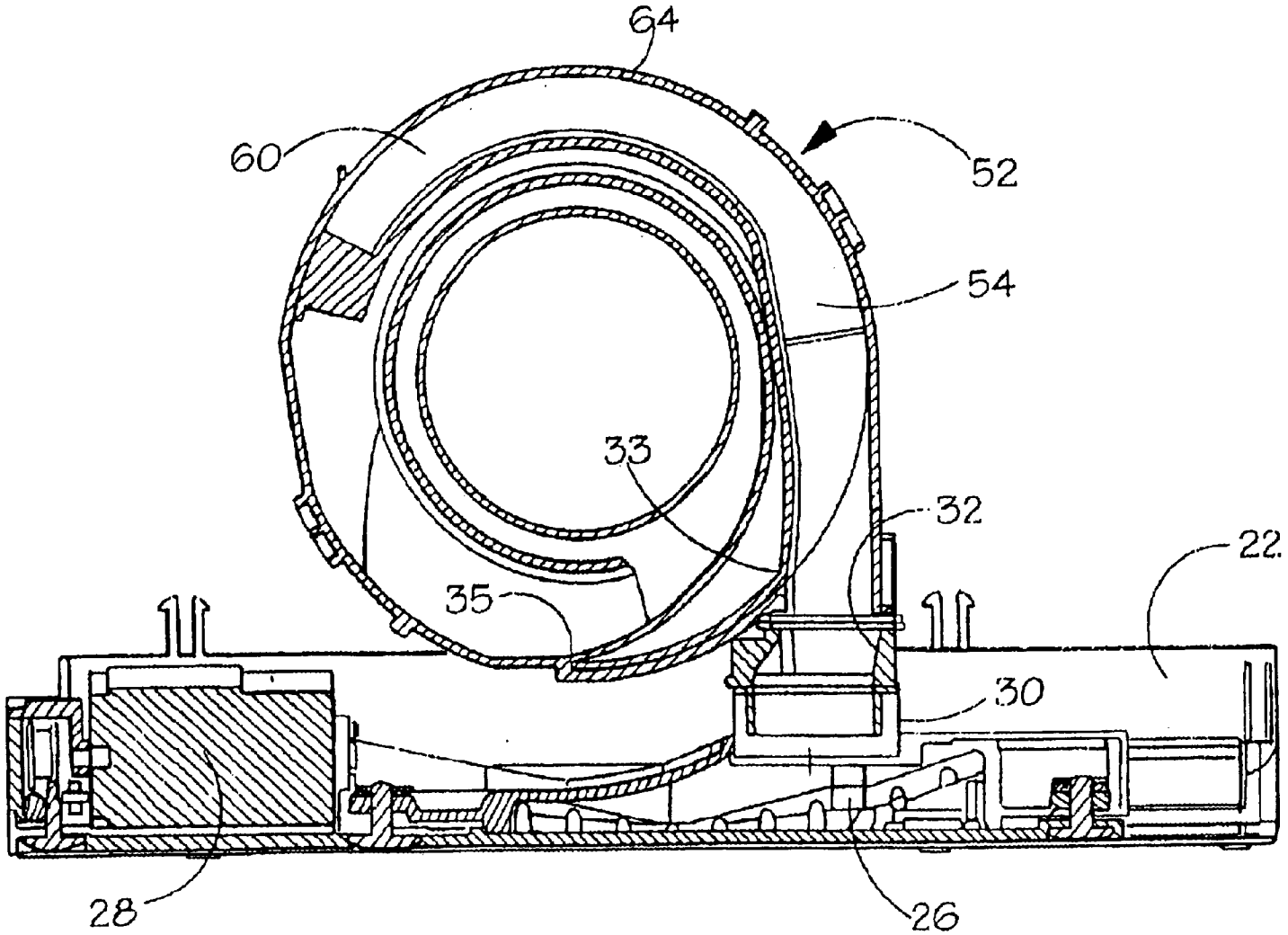
FIG. 7 is a sectional view taken along than line VI—VI of FIG. 6 showing only the cleaner head and the cyclonic separator of the vacuum cleaner of FIG. 1.

A single fin or baffle 78 is moulded integrally with the fine dust collector 74 and extends radially outwardly from the second cylindrical portion 74*b* and from the frusto-conical portion 74*c* (see FIG. 6). The outer edge 78*a* of the fin 78 is aligned with the first cylindrical portion 74*a* and also with the wall of the shroud 80. The inclined edge 78*b* of the fin 78 remote from the first cylindrical portion 74*a* lies essentially parallel to the frusto-conical portion 74*c*. The outer and inclined edges 78*a*, 78*b* are joined by a smooth curve moulded into the fin 78.

The single fin 78 extends upwardly from the fine dust collector 74. The angle at which the fin extends can be varied within certain limits and it is not intended that the fin may only extend upwardly at 90° to a horizontal plane. However, the capacity of the bin 62 is put to the best use if the fin 78 does extend from the fine dust collector generally upwardly towards the wall of the bin 62. The radial extent of the fin 78 may also vary. In the illustrated embodiment, the fin 78 extends approximately one half of the distance between the fine dust collector and the bin 62, although it is envisaged that this distance could be varied between one quarter and one half of the said distance.

A shroud 80 is located between the first and second cyclones 54, 56. The shroud 80 is cylindrical in shape and is supported at one end by the entry portion 58 and by the cyclone body 72 of the inner cyclone 56 at the other end. As is known, the shroud 80 has perforations 82 extending therethrough and a lip 83 projecting from the end of the shroud 80 remote from the entry portion 58. A channel 84 is formed between the shroud 80 and the outer surface of the cyclone body 72, which channel 84 communicates with an entry port 86 leading to the interior of the inner cyclone 56 in a manner which forces the incoming airflow to adopt a swirling, helical path. This is achieved by means of a tangential or scroll entry into the inner cyclone 56 as can be seen from FIG. 7. A vortex finder (not shown) is located centrally of the larger end of the inner cyclone 56 to conduct air out of the cyclonic separator 52 after separation has taken place. The exiting air is conducted past the motor and fan unit 50 so that the motor can be cooled before the air is excelled to atmosphere. Additionally, a post-motor filter (not shown) can be provided downstream of the motor and fan unit 50 in order to further minimise the risk of emissions into the atmosphere from the vacuum cleaner.

The entire cyclonic separator 52 is releasable from the chassis 12 in order to allow emptying of the outer and inner cyclones 54, 56. A hooked catch (not shown) is provided adjacent the inlet port 32 by means of which the cyclonic separator 52 is held in position when the cleaner 10 is in use. When the hooked catch is released (by manual pressing of a button 34 located in the control panel 44), the cyclonic separator 52 can be lifted away from the chassis 12 by means of the gripper portions 70. The bin 62 can then be released from the entry portion 58 (which carries with it the shroud 80 and the inner cyclone body 72) to facilitate the emptying thereof.

The vacuum cleaner 10 described above operates in the following manner. In order for the cleaner 10 to traverse the area to be cleaned, the wheels 14 are driven by the motors 15 which, in turn, are powered by the batteries 46. The direction of movement of the cleaner 10 is determined by the control software which communicates with the sensors 40 which are designed to detect any obstacles in the path of the cleaner 10 so as to navigate the cleaner 10 around the area to be cleaned. Methodologies and control systems for navigating a robotic vacuum cleaner around a room or other area are well documented elsewhere and do not form part of the inventive concept of this invention. Any of the known methodologies or systems could be implemented here to provide a suitable navigation system.

The batteries 46 also provide power to operate the motor and fan unit 50 to draw air into the cleaner 10 via the suction opening 24 in the cleaner head 22. The motor 28 is also driven by the batteries 46 so that the brush bar 26 is rotated in order to achieve good pick-up, particularly when the cleaner 10 is to be used to clean a carpet. The dirty air is drawn into the cleaner head 22 and conducted to the cyclonic separator 52 via the telescopic conduit 30 and the inlet port 32. The dirty air then enters the entry portion 58 in a tangential manner and adopts a helical path by virtue of the shape of the helical wall 60. The air then spirals down the interior of the outer wall 64 of the bin 62 during which motion any relatively large dirt and fluff particles are separated from the airflow. The separated dirt and fluff particles collect in the end of the bin 62 remote from the entry portion 58.

The fin 78 discourages uneven accumulation of dirt and fluff particles and helps to distribute the dirt and fluff collected around the end of the bin 62 in a relatively even manner. It achieves this by providing a baffle against which dirt and dust separated in the outer cyclone 54 can accumulate. The constant airflow within the bin 62 presses the separated dirt and dust against the fin or baffle 78 and a build-up of dirt and dust occurs. The location of the fin or baffle 78 at an uppermost point within the bin 62 means that the initial build-up of dirt and dust is located in that area. As the build-up of dirt and dust continues, the accumulated dirt and dust forms builds up around the inner wall of the bin 62 and the accumulation is relatively even and uniform. The provision of the fin or baffle 78 parallel to the direction of the tangential inlet port 32 maximises the amount of separated dirt and dust which can be accommodated in the bin 62.

The airflow from which dirt and larger fluff particles has been separated moves inwardly away from the outer wall 64 of the bin 62 and travels back along the exterior wall of the fine dust collector 74 towards the shroud 80. The presence of the shroud 80 also helps to prevent larger particles and fluff traveling from the outer cyclone 54 into the inner cyclone 56, as is known. The air from which comparatively large particles and dirt has been separated then passes through the shroud 80 and travels along the channel between the shroud 80 and the outer surface of the inner cyclone body 72 until it reaches the inlet port 86 to the inner cyclone 56. The air then enters the inner cyclone 56 in a helical manner and follows a spiral path around the inner surface of the cyclone body 72. Because of the frusto-conical shape of the cyclone body 72, the speed of the airflow increases to very high values at which the fine dirt and dust still entrained within the airflow is separated therefrom. The fine dirt and dust separated in the inner cyclone 56 is collected in the fine dust collector 74 outwardly of the dust ring 68. The dust ring 68 discourages re-entrainment of the separated dirt and dust back into the airflow.

When the fine dirt and dust has been separated from the airflow, the cleaned air exits the cyclonic separator via the vortex finder (not shown). The air is passed over or around the motor and fan unit 50 in order to cool the motor before it is expelled into the atmosphere.

As shown in FIGS. 6 and 7, the inlet 32 to the cyclonic separator 52 couples to the transfer conduit 30 at the base of the cleaner. The inlet 32 extends from the lower part the separator, i.e. the half of the separator nearest the base of the cleaner, and is generally vertically oriented. Locating the inlet 32 here permits a very short airflow path between the cleaner head 26 and the cyclonic separator 52, which minimises losses. It also provides an airflow path which is substantially straight and free from undue bends. However, this location of the inlet 32 has a risk that the user, in releasing the separator 52 from the chassis 12, can tip the separator 52 backwardly such that the inlet 32 of the bin 62 is lowermost and the dirt collection end is uppermost. This can result in dirt and dust moving towards the inlet 32. A similar problem can occur when the separator 52 is filled beyond its recommended dirt capacity. In normal use dirt settles at the end of the separator 52 remote from the inlet 32, but during overfill conditions dirt settles in the separator rear to the inlet 32. This can lead, to re-entrainment of separated dust back into the airflow path during operation.

A shield member serves to prevent dirt from falling out of the inlet 32, when the user removes the separator unit 52 or when a user allows the separator 52 to become overfilled.

Figure 8:
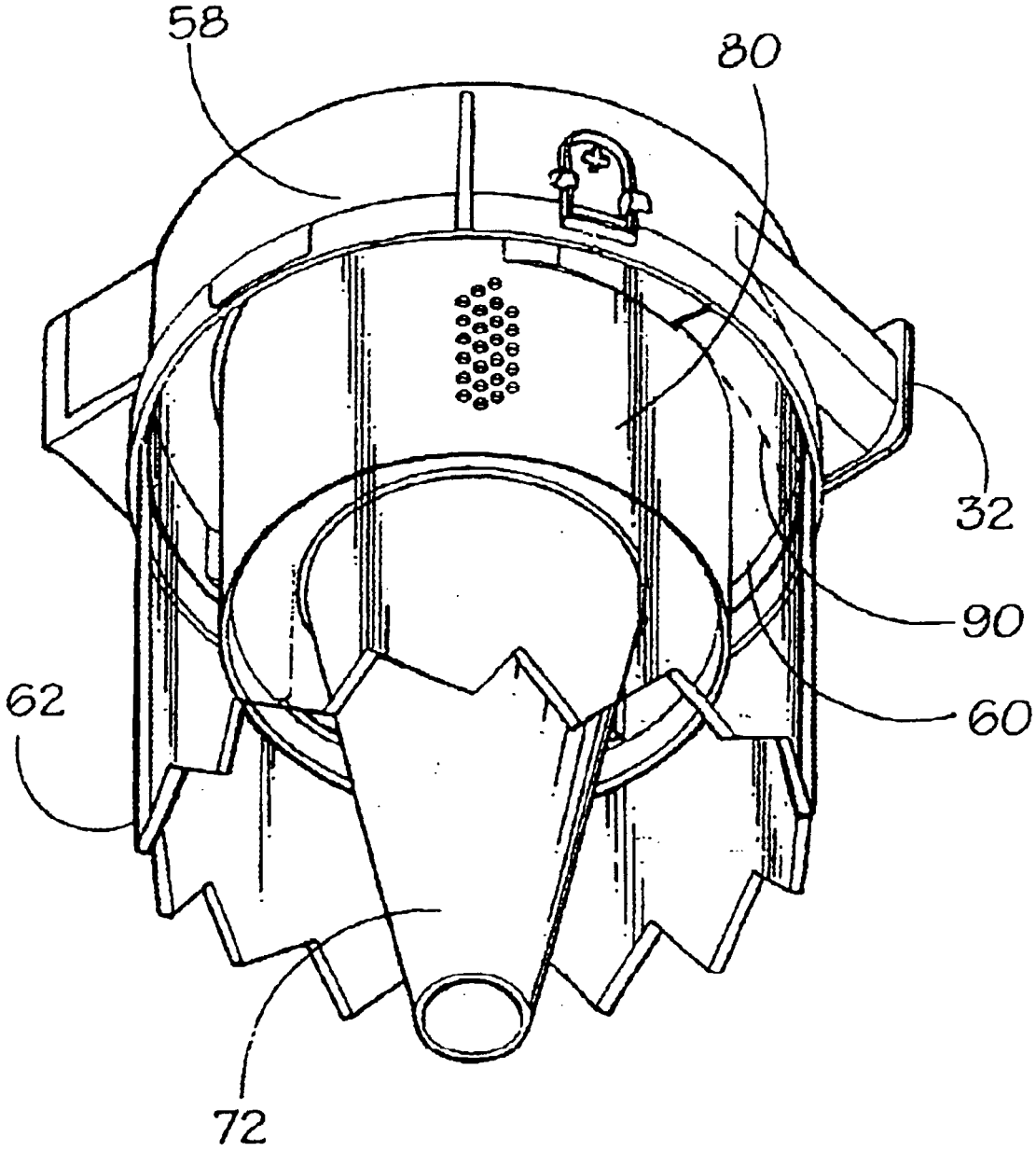
FIG. 8 is a side perspective view of a shroud and entry portion assembly according to an embodiment of the invention.
Figure 9:
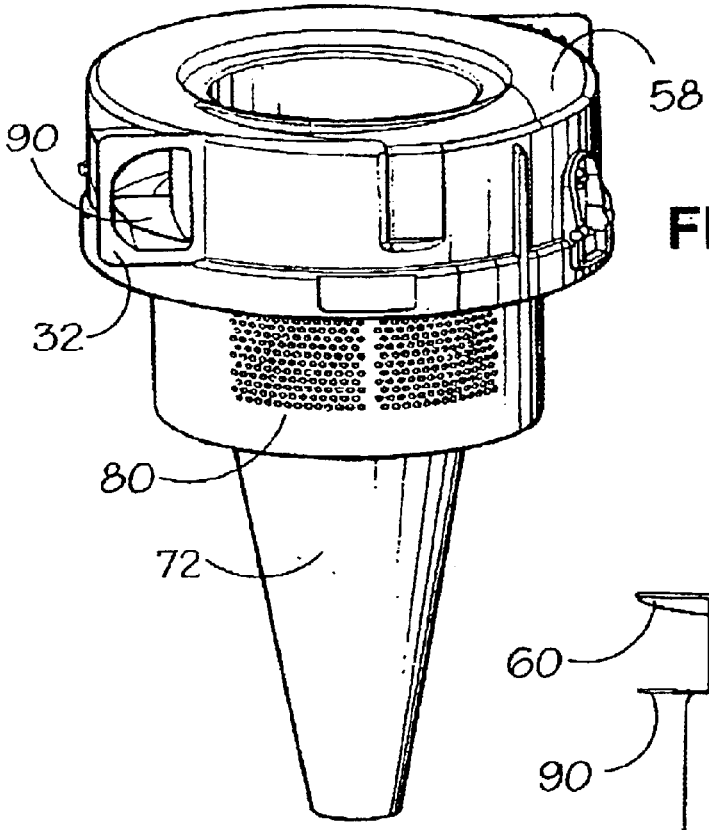
FIG. 9 is a side perspective view of part of a cyclonic separating unit.
Figure 11:
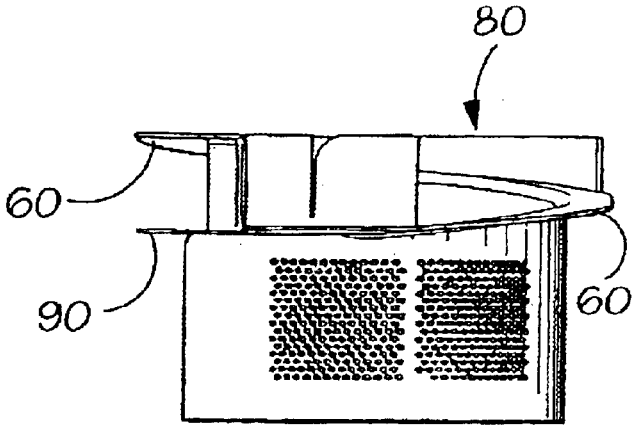
FIG. 11 is a side view of the shroud of FIG. 10.
Figure 10:
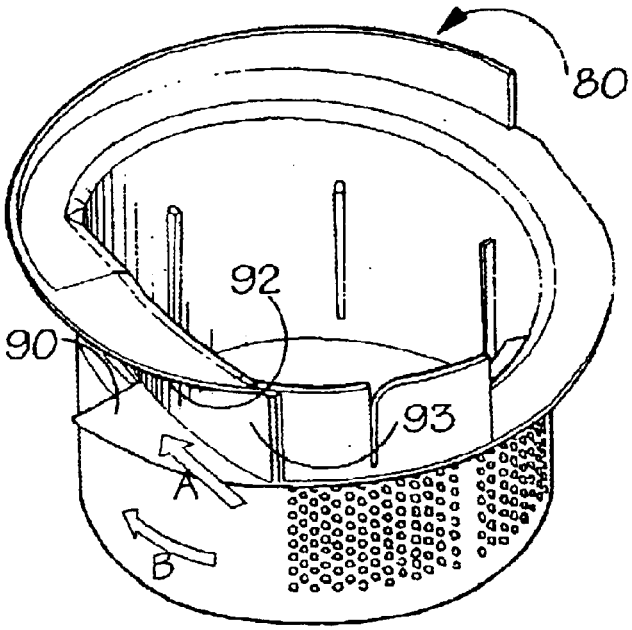
FIG. 10 is a perspective view of a shroud in accordance with an embodiment of the invention.

FIGS. 8–11 show a preferred form of the shield member. FIGS. 8 and 9 show the entry portion 58, shroud 80 and inner cyclone 72 assembly which fits inside bin 62 (shown in FIG. 8) of the separator. A fin 90 is formed integrally with the shroud 80. FIGS. 10 and 11 show just the shroud 80, having the guide 60 winding in a helical fashion around its upper end which serves to guide incoming air arriving in the separator into a helical path. The fin 90 forms an extension of the helical guide 60, forming the beginning of a second revolution around the chamber. Incoming air from inlet port 32 of the entry portion 58 flow, along path A, bounded by the beginning of the helical path 92 on one side, shield fin 90 on the opposite side, wall 93 and the outer wall of entry portion 58. The air flows in a circular fashion (clockwise in FIG. 10) around the upper end of the shroud part, continuing along path B underneath shield 90 and proceeding to flow around the outer cyclone chamber 54 as previously described.

Fin 90 projects radially from the shroud piece and, when assembled with the entry portion 58, abuts an outer wall of the entry portion 58. Dirt, dust and other debris which is collected in the bin 62 during operation of the separator 52 is prevented from falling down the inlet by the fin 90. The inlet is shielded on an inner face by wall 93, forming part of the shroud piece. The fin 90 has a further advantage in that it has a straightening effect on the incoming airflow which helps to improve separation efficiency of the cyclone. This is a particular advantage where the inlet conduit preceding the cyclonic separator 52 is very short, as it is in the illustrated embodiment (see FIG. 7.)

The length of fin 90 is a trade off between increased shielding and airflow losses. A longer fin provides improved shielding for the inlet but introduces a small loss due to the fact that the airflow path is being constrained for a greater distance.

It has been found to be cost-effective to mould the shield 90 integrally with shroud part 80 but it will be appreciated that other arrangements are possible. For example, the shield could be realised as a fin moulded as part of the bin 62 or entry portion 58, the fin extending radially inwardly from the outer wall of entry portion 58.

Figure 12:
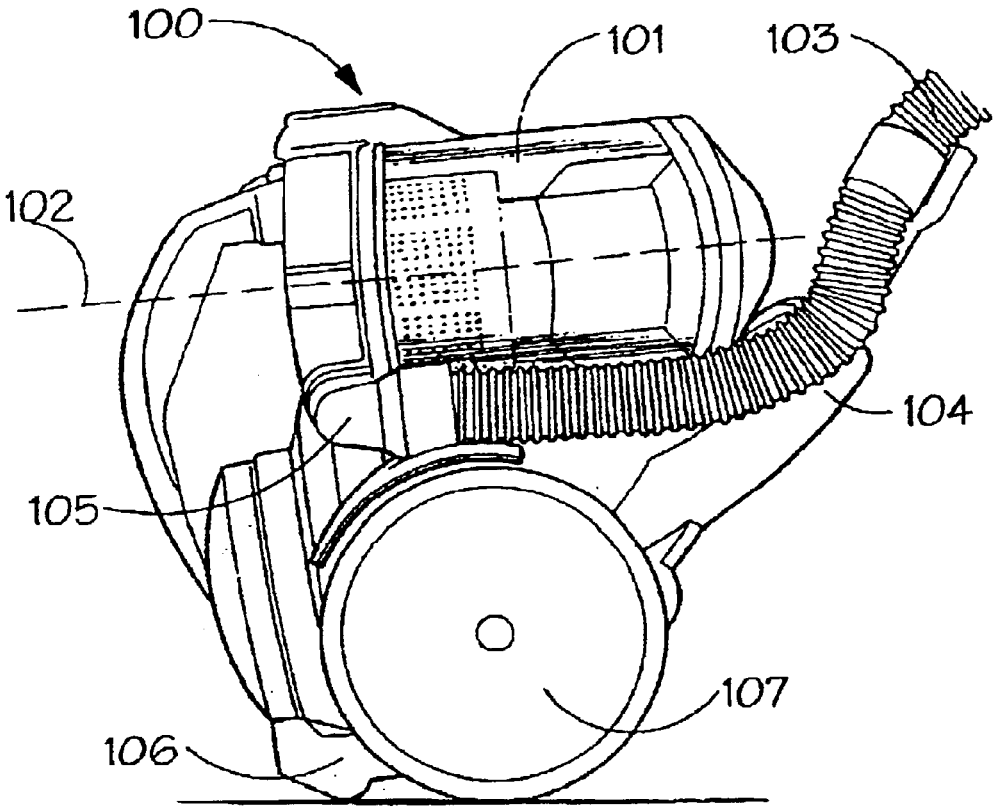
FIG. 12 is a side view of another type of vacuum cleaner in which the invention can be applied; and, FIG. 13 is a cross-sectional view through the cleaner of FIG. 12.

The above embodiment describes a robotic vacuum cleaner, but it will be appreciated that the invention can be applied to manual vacuum cleaners. FIG. 12 shows a cylinder-type cleaner 100 which is manually operated in a conventional manner. This has a cyclonic separator 101 with an inlet 105 feeding incoming dirty air from a hose 103 tangentially into the separator 101. The inlet 105 to the cyclonic separator 101 is located at the lower end of the separator 101. When the separator chamber 101 is viewed in cross-section, the inlet is located on the side of the separator which is nearest the base of the cleaner 100. This location of the inlet 105 allows the hose 103 to be routed along the base of the separator 101 and avoids the need for the hose, or any additional airflow conduit, to guide the incoming airflow to the top of the separator 101. The cleaner 100 has a chassis with a pair of wheels 107 and a rear support 106. The cleaner 100 normally rests in a position where forward support 104 lies on the floor and the longitudinal axis 102 of the cyclonic separator 101 is in an inclined position with the end of the separator 101 housing the inlet 105 lying uppermost. However, the cleaner 100 can be reclined to the position shown in FIG. 12 where the cleaner rests on support 106, bringing the longitudinal axis 102 of the cyclonic separator 101 into a reclined position. The same inlet and shield arrangement shown in FIGS. 8–11 can be used in cleaner 100 to prevent dirt and dust from moving toward inlet 105 during the time that the cleaner is used in the reclined position.

Figure 13:
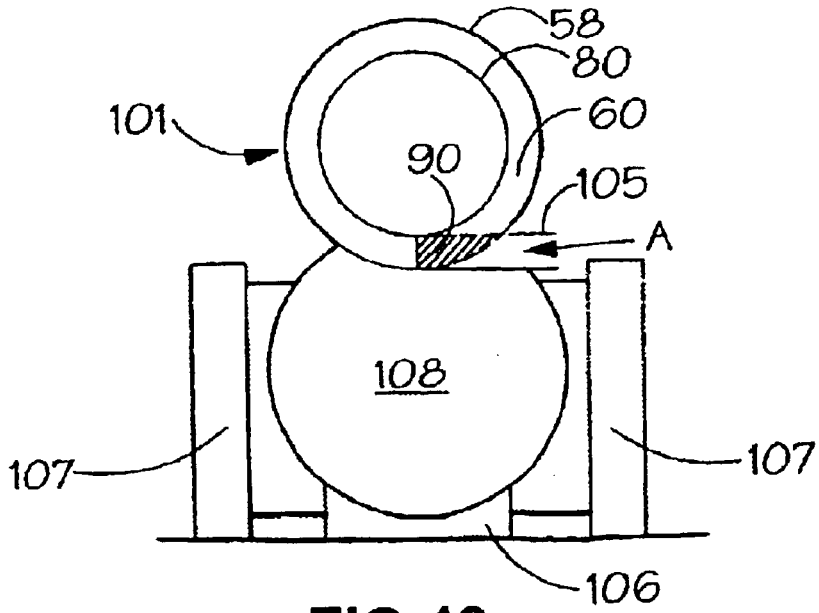

FIG. 13 is a cross-sectional view through the rear of the cleaner 100 of FIG. 12 which more clearly shows the inlet 105. Separator 101 is supported above a part 108 of the cleaner housing that houses a fan motor and filter. Inlet 105 introduces air (flow A) tangentially into the separation chamber through a side wall of the chamber in a direction which is generally horizontal with respect to the base of the cleaner 100. The air then flows clockwise around the shroud 80 inside the separator 101, guided by helical guide 60. The shield member 90, shown with diagonal shading, extends around the circumference of the chamber for a greater distance than the inlet opening to fully shield the inlet port to the chamber. The shield member could extend further around the circumference of the chamber than is shown here.

What is claimed is:

1. A vacuum cleaner, comprising:

a cyclonic separation unit, the unit comprising:

a chamber having a dirty air inlet;

a cleaned air outlet at a first end thereof;

a dirt collection portion at a second end thereof, wherein the unit cleans dirty air entering the inlet by centrifugal separation and stores the dirt in the dirt collection portion, the unit is supported on the, cleaner such that the inlet is located in a lower portion of the first end of the chamber and such that the longitudinal axis of the chamber is configured to lie in a substantially horizontal position; and a shield member is provided at the inlet for shielding the inlet from the dirt collection portion of the chamber.

2. The vacuum cleaner according to claim 1, wherein the separation unit is supported on the cleaner such that the longitudinal axis of the chamber lies in an upwardly inclined position to a horizontal axis with the dirt collection portion lowermost, and such that the cleaner is configured to be reclined to lie in a position where the longitudinal axis of the chamber lies in a substantially horizontal or backwardly inclined position.

3. The vacuum cleaner according to claim 1, wherein a circumferential length of the shield member is at least as great as a circumferential length of the inlet.

4. The vacuum cleaner according to claim 1, wherein the shield is a fin which extends radially inwards from an outer wall of the chamber.

5. The vacuum cleaner according to claim 1, wherein the unit has a helical entry guide extending from one side of the inlet and the shield extends parallel to the entry guide on the other side of the inlet.

6. The vacuum cleaner according to claim 5, wherein the shield member is an extension of the helical entry guide, forming the beginning of a second revolution around the chamber.

7. The vacuum cleaner according to any one of the preceding claims, further comprising an insert which fits inside the chamber adjacent to the inlet, and wherein the shield extends inwardly to the insert.

8. The vacuum cleaner according to claim 7, wherein the shield is formed integrally with the insert.

9. The vacuum cleaner according to claim 7, wherein the insert is a shroud.

10. The vacuum cleaner according to any one of claims 1 through 6, wherein the inlet is oriented in a substantially vertical direction and the shield extends vertically alongside the inlet.

11. The vacuum cleaner according to any one of claims 1 through 6, further comprising a cleaner head and wherein the separation unit is mounted above the cleaner head and is directly coupled to an outlet of the cleaner head.

12. The vacuum cleaner according to claim 1, wherein the separation unit is releasably supported on the cleaner.

13. The vacuum cleaner according to claim 1, wherein the inlet is a tangential inlet to the chamber.

14. The vacuum cleaner according to any one of claims 1 through 6, wherein the cleaner is an autonomous cleaner further comprising a chassis supporting the cyclonic separation unit and a drive device to autonomously drive the cleaner over a surface to be cleaned.

15. The vacuum cleaner according to claim 2, wherein a circumferential length of the shield member is at least as great as a circumferential length of the inlet.

16. The vacuum cleaner according to claim 8, wherein the insert is a shroud.

17. The vacuum cleaner according to claim 7, wherein the inlet is oriented in a substantially vertical direction and the shield extends vertically alongside the inlet.

18. The vacuum cleaner according to claim 11, wherein the inlet is oriented in a substantially vertical direction and the shield extends vertically alongside the inlet.

19. The vacuum cleaner according to claim 7, further comprising a cleaner head and wherein the separation unit is mounted above the cleaner head and is directly coupled to an outlet of the cleaner head.

20. The vacuum cleaner according to claim 10, further comprising a cleaner head and wherein the separation unit is mounted above the cleaner head and is directly coupled to an outlet of the cleaner head.

21. The vacuum cleaner according to claim 7, wherein the cleaner is an autonomous cleaner further comprising a chassis supporting the cyclonic separation unit and a drive device to autonomously drive the cleaner over a surface to be cleaned.

22. The vacuum cleaner according to claim 10, wherein the cleaner is an autonomous cleaner further comprising a chassis supporting the cyclonic separation unit and a drive device to autonomously drive the cleaner over a surface to be cleaned.

23. The vacuum cleaner according to claim 11, wherein the cleaner is an autonomous cleaner further comprising a chassis supporting the cyclonic separation unit and a drive device to autonomously drive the cleaner over a surface to be cleaned.

* * * * *

UNITED STATES PATENT AND TRADEMARK OFFICE

CERTIFICATE OF CORRECTION

PATENT NO. : 6,818,036 B1
DATED : November 16, 2004
INVENTOR(S) : Robert Brian Seaman It is certified that error appears in the above-identified patent and that said Letters Patent is hereby corrected as shown below:

Column 9,
Line 57, the comma in the phrase "on the, cleaner" should be deleted.

Signed and Sealed this

Twenty-second Day of February, 2005

JON W. DUDAS
*Director of the United States Patent and Trademark Office*